United States Patent [19]

Metrailer

[11] 3,940,105

[45] Feb. 24, 1976

[54] FORM SUPPORT FOR USE IN MAKING ARCHED CEILING

[76] Inventor: Charles E. Metrailer, 4656 Bluebonnet Drive, Baton Rouge, La. 70809

[22] Filed: Nov. 19, 1973

[21] Appl. No.: 416,961

[30] Foreign Application Priority Data

Apr. 12, 1973 Canada ..... 168579

[52] U.S. Cl. ..... 249/209; 249/18; 249/27

[51] Int. Cl.[2] ..... E04G 11/56

[58] Field of Search..... 425/62; 249/24, 26–30, 249/11, 12, 209–212; 52/639, 640–641, 644–645

[56] References Cited

UNITED STATES PATENTS 3,744,945 7/1973 Metrailer ..... 249/27

FOREIGN PATENTS OR APPLICATIONS 415,742 1946 Italy ..... 249/209

447,328 1949 Italy ..... 249/209

*Primary Examiner*—Robert D. Baldwin

*Assistant Examiner*—John McQuade

*Attorney, Agent, or Firm*—L. A. Proctor

[57] ABSTRACT

Apparatus for modular concrete constructions. The apparatus comprises a carriage and a concrete form. It also comprises the combination of a concrete form detachably mounted on a portable carriage the former of which can be set in place and positioned for pouring. The carriage can then be detached from the concrete form, removed for further service and later reunited with the form for transport to a new pour position, as desired. The concrete form per se is comprised generally of a support structure atop which is provided a pour form. The pour form is constituted of a central span and, preferably, a pair of upwardly faced troughs located on opposite sides of the central span. The central span of the pour form can range from flat to highly contoured. The troughs are each provided with a plurality of bottom openings, these being formed between removable panels. In forming a module, wet concrete can be poured upon the central span of the pour form to form a roof, ceiling, or floor while a tubular member or column form can be fitted into the openings of the troughs at the column locations and wet concrete can be poured therein and into the troughs to cast columns and beams for support of the roof, ceiling or floor. After the concerete has set the pour form can be lowered, the troughs freed by removal of the panels at the columns, and the beam forms moved inwardly. The carriage can then be removed to an adjacent location for further pouring.

8 Claims, 19 Drawing Figures

FORM SUPPORT FOR USE IN MAKING ARCHED CEILING

Portable carriages, the upper portion of which is provided with collapsible wall structures, or forms, for use in building or repairing arches, tunnels, and the like are known to the art. In a typical structure of such type, a railway flat car, or similar transportable carriage, is provided with a permanently attached elevatable form, usually of oval contour, for providing temporary support for stone, brick, concrete block, masonry or plastic like masses such as concrete. In a typical construction, a flat foundation slab is laid and rails are constructed thereon. The carriage is placed on the rails, the material to be used in the repair or construction is placed on the form, and the latter is used to elevate and place the materials in the proper position for the repair or construction. Where, e.g., a tunnel is being constructed of concrete, the wet concrete is thrust upward and held in place against the top of the tunnel until the concrete has set. The form is then collapsed, perhaps lowered and the carriage then moved with the form intact to an adjacent position to form another segment of the tunnel.

Such carriages have proven successful in the past for the repair and construction of sewers, tunnels and the like. They have saved time, labor and expense, particularly in concrete construction when contrasted with the use of forms which must be built and then torn down for each individual pour. The devices nonetheless have limited utility, and only in recent years have devices of such character been sufficiently improved that they have become acceptable in non-tunnel construction.

In U.S. Pat. No. 3,320,646 to A. H. Wilkins, for example, a portable carriage, equipped with an elevated pour section, with pivotally connected end portions, is employed for casting monolithic concrete roof structures. The roof section or roof modules that are formed are set on prefabricated pillars, and the carriage is moved from one pair of prefabricated pillars to another as a roof section is formed. This and other such prior art devices have their limitations.

Among the objects of this invention are:

To provide new and improved apparatus for modular constructions.

To provide a transportable concrete form with detachable carriage, both of unique design, the concrete form of which can be set in place for receipt of plastic-like masses such as concrete and the like, for setting and converting same to desirable modular construction forms, including not only roofs, ceiling, floors and the like, but also beams and columns.

To provide the apparatus combination such as described wherein the carriage can be readily detached from the concrete form, removed for further service and later reunited with the concrete form for transport thereof, such combination being particularly useful for simultaneously pouring the above construction forms, including specifically floors, roofs, beams and columns whereupon the form can be released from the set concrete and transported by the carriage across a foundation or floor for different continous modular pours, and then moved, if desired, to the next upper level for further pouring.

These objects and others are achieved in accordance with the present invention the apparatus embodiment of which comprises a concrete form and carriage, particularly the combination of a concrete form and detachable carriage, as generally described. In operation, the concrete form is transported to and set in place by the carriage which is particularly adapted by two different sets of wheels, one set mounted at right angles to the other, to provide mobility for the setting and alignment of the concrete form. The concrete form is comprised of a concrete pour form, or forms, mounted on structural elements, including vertical posts supported on the carriage frame, by virtue of which the concrete pour form, or forms, can be supported and elevated or lowered with respect to the carriage, this providing flexibility such that the pour form, or forms, can be readily positioned for pouring. In position, the concrete form, in a preferred embodiment, is additionally supported by vertical shoring members. The carriage can be separated from the concrete form after the latter is positioned, removed for further service, and later reattached with the concrete form to transport the latter to a new pour position or location.

The invention, and its principle of operation, will be more fully understood by reference to the following detailed description of a specific embodiment, and to the attached drawings to which reference is made in the description. In the description, similar numbers are used to represent similar parts or components.

Figure 1:
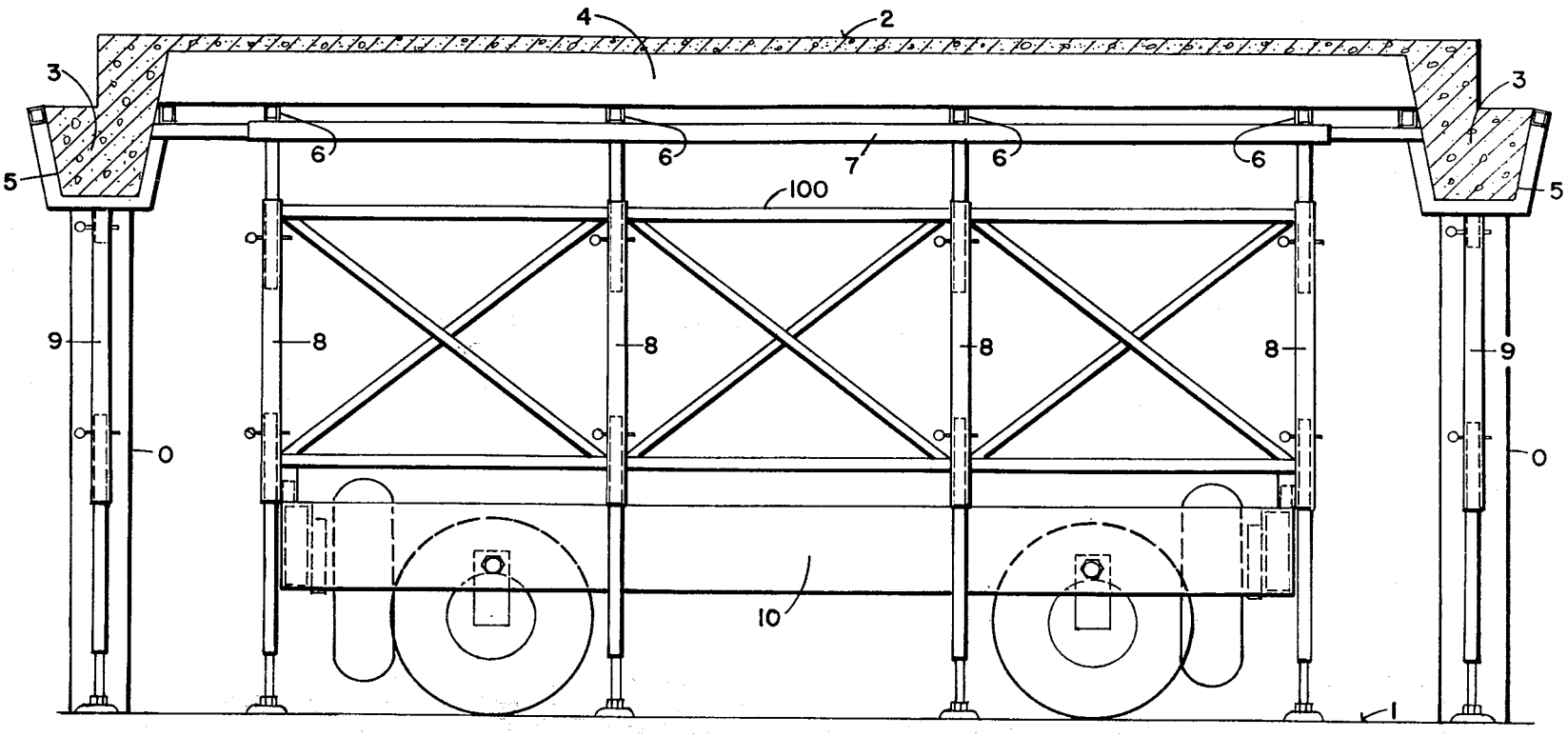
FIG. 1 is a side elevation of a preferred type of portable carriage and concrete form or concrete form assembly, the preferred combination being shown in position for pouring concrete.

With reference to FIG. 1 of the drawings, reference character 1 designates a concrete slab on grade or the floor slab of lower floors in a multi-story building made in accordance with the present invention. The horizontally oriented slab 2 is constructed as a unitary member having a plurality of horizontally disposed ribbed lower sections, and it is abutted by vertically disposed reinforced beam members 3 disposed in parallel planes. The beam members 3 are supported by vertically oriented columns 0, also made in accordance with the present invention. The reinforcing members 3, as well as the horizontal slab 2 and columns 0, include internally disposed steel reinforcing (not shown) as is well-known in the building art, which reinforces these portions of the floor normally in tension. The design of the particular floors will, of course, be varied with the requirements of the building, in accordance with established engineering procedures, and need not be further elaborated upon in this disclosure.

The apparatus of this invention is comprised generally of a carriage 10 and a transportable concrete form support 100. The portable carriage 10 and transportable concrete form support 100, which is detachably mounted on the carriage 10, are preferably used in combination. The body of the portable carriage per se (FIG. 2) is constituted generally of a reinforced frame body fitted with wheels, and means whereby the said carriage can be attached to a vehicle and towed to a work site. The concrete form support 100, which is adapted for transport upon the carriage 10, is constituted generally of a frame structure on the top of which is supported a pour form, including a central portion or span and upwardly faced troughs or trough-like members, with a plurality of bottom openings, located alongside the central span for receipt of poured concrete. The pour form support of the transportable concrete form 100 is constituted generally of a central span 4 and upwardly faced troughs or trough-like members 5 for receipt of poured concrete. The frame structure per se comprises a plurality of telescoping tubular shaped vertical posts 8 secured together by supporting horizontal posts which connect to top and bottom portions of adjacent vertical posts 8. Diagonal reinforcing members are also connected to the bottom and top portions of vertical posts 8, these being employed to further support and strengthen the frame structure. Shoring members 9, constituted of telescoping tubular members similar in purpose and function to vertical posts 8 are also provided to support the troughs 5. Jacks 13 are provided with the lower terminal ends of each of the several vertical posts 8 as well as within the lower terminal ends shoring members 9 which are used to support the troughs 5.

Figure 3:
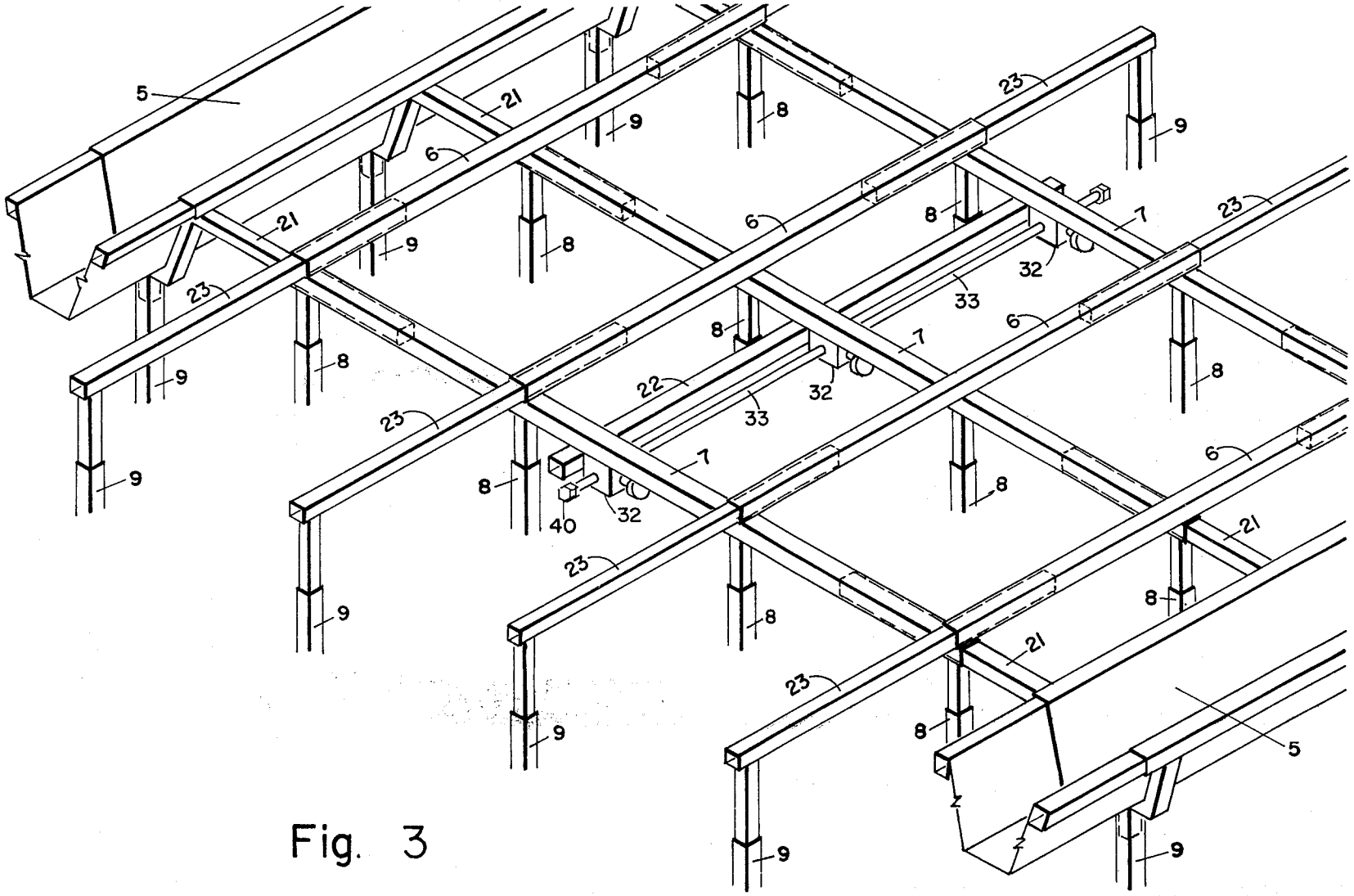
FIG. 3 is a fragmentary isometric view showing the vertical posts, shoring members and other telescoping components which constitute the upper portion of the concrete form support structure.
Figure 4:
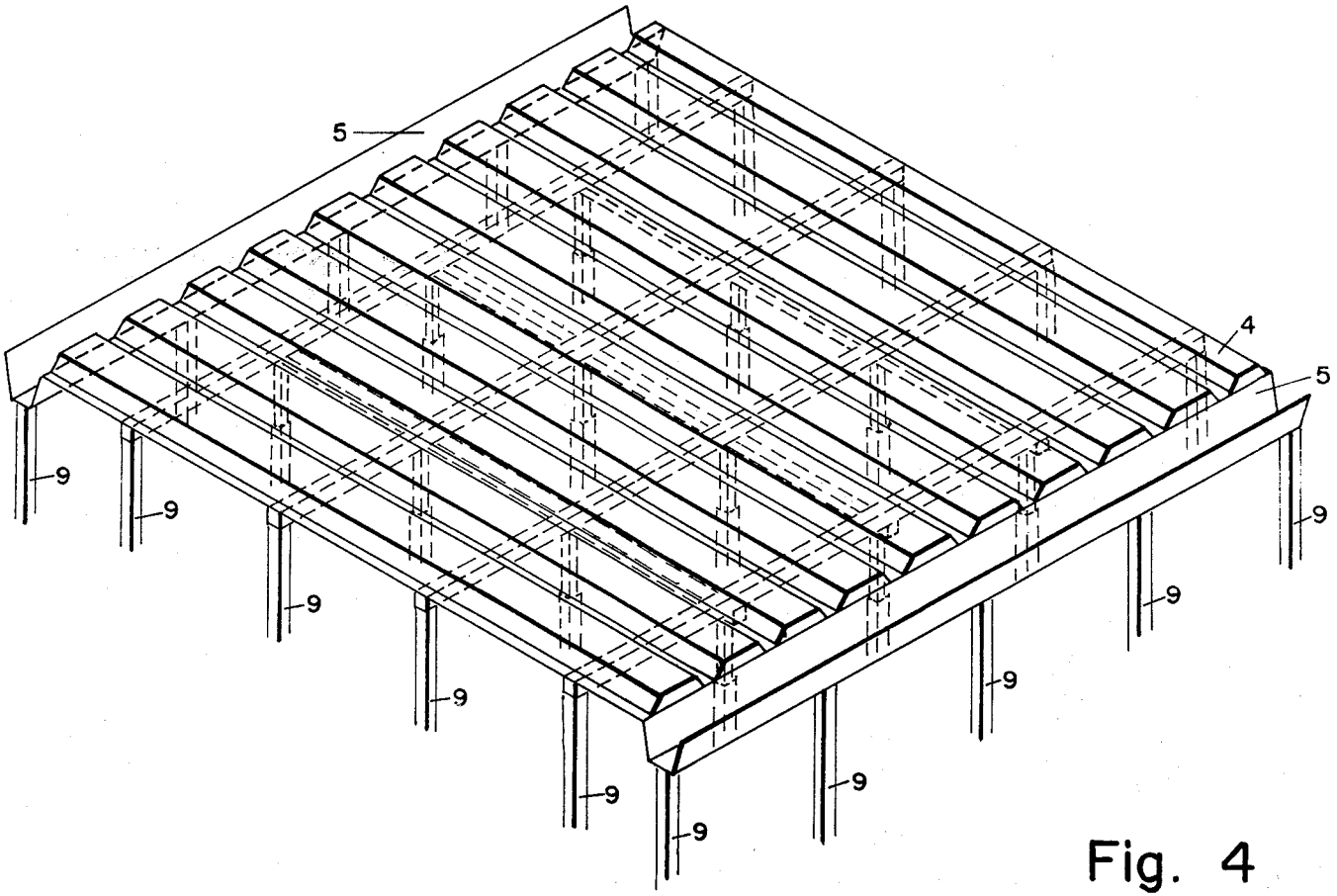
FIG. 4 is a isometric view showing the concrete pan form sections and beam forms of the concrete form assembly, or pour forms, installed over the supporting members ready for pouring concrete.
Figure 5:
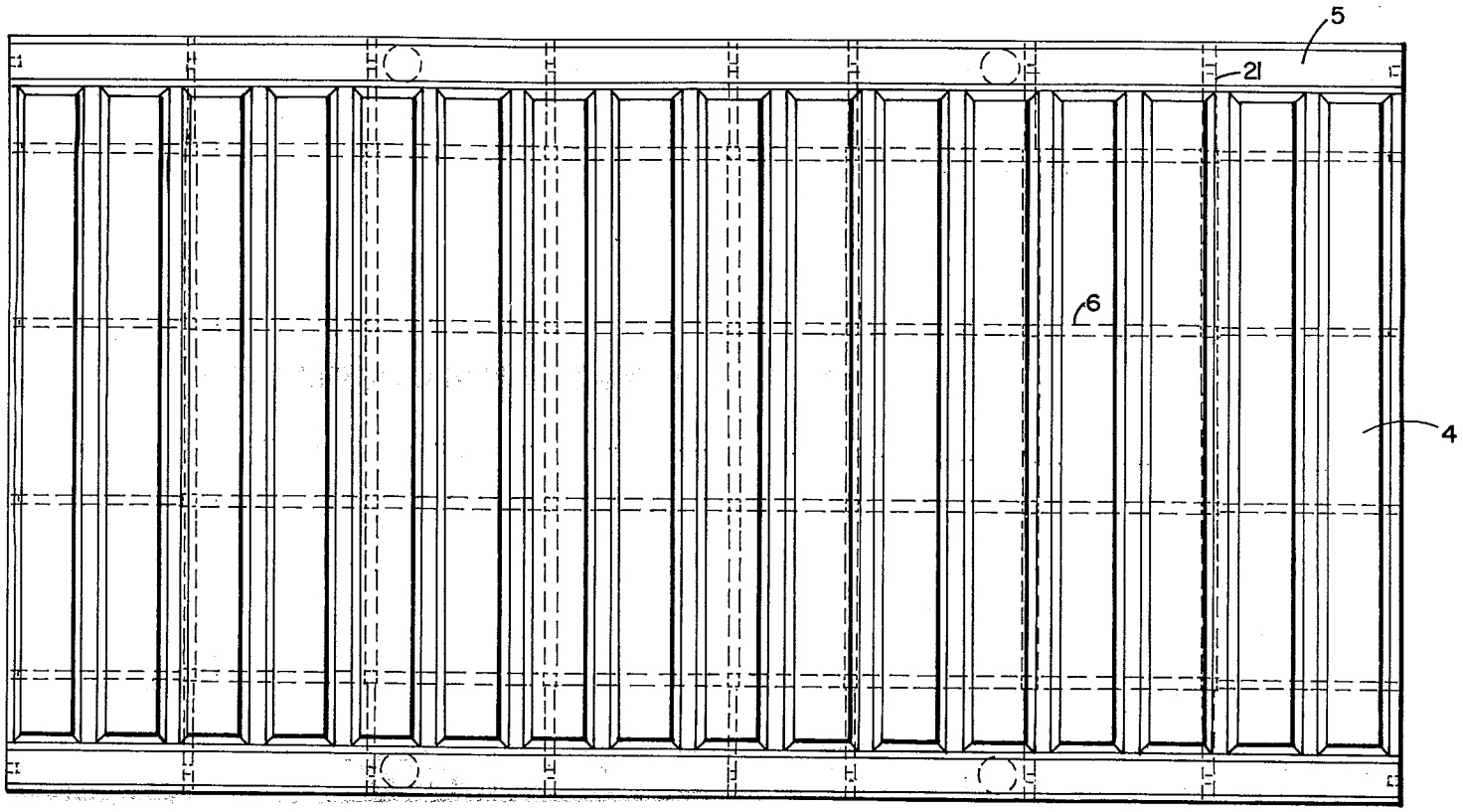
FIG. 5 is a plan view showing a contiguous pair of concrete pan form sections ready for pouring a monolithic selfsupporting concrete structure including four columns two beams and central span.

Referring specifically to FIGS. 3 and 4, it will be observed that the pour form, which includes central span 4 and upwardly faced troughs 5, rests upon and are supported by horizontal beams 6, 7. Beams 7 are parallelly alligned, one with respect to another, and are directly perpendicularly affixed to the top terminal ends of the innermost tubular members of vertical posts 8. Beams 6, on the other hand, are also parallelly alligned one member with respect to the other, but lie at right angles to beams 7, and are affixed to the upper sides thereof. The beams 6, 7 also contain smaller telescoping tubular members 23, 21, respectively. The terminal ends of the latter tubular members 21 are U-shaped to support troughs 5, and both tubular members 23, 21 are supported by shoring members 9 affixed to the ends thereof. The shoring members are particularly useful where, as observed by reference to FIG. 4, the troughs 5 are projected outwardly and the central span 4, which comprises a concrete form element, are loaded with wet concrete.

Figure 12:
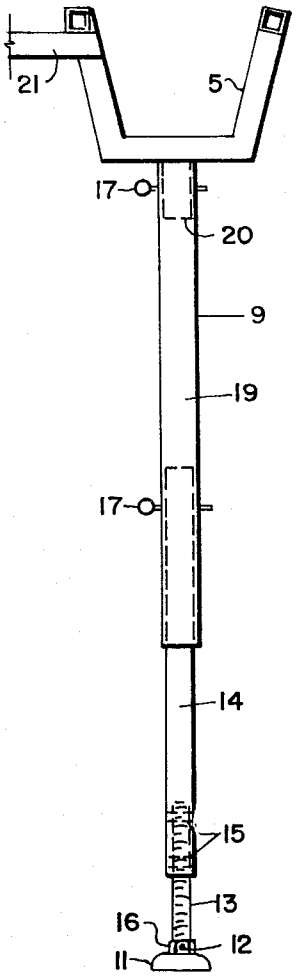
FIG. 12 is a fragmentary elevation view showing one of the removable vertical support members or shoring members for the beam forms.
Figure 13:
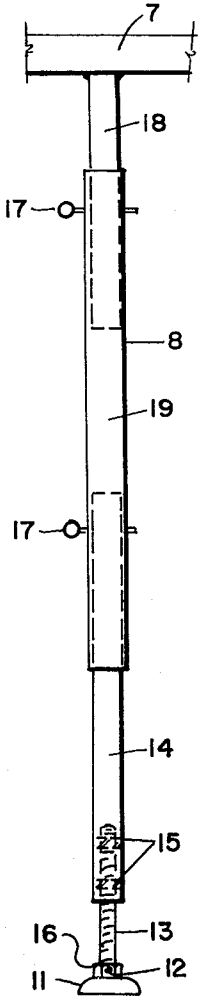
FIG. 13 is a fragmentary elevation view showing one of the vertical support members used in supporting the pan form frames.

The design and function of the vertical posts 8 and the shoring members 9 are quite similar and accordingly a complete description of one each of these elements will describe all of the several elements employed. Referring specifically to FIGS. 12 and 13, which describes these members in detail, it will be observed that each vertical post 8 and shoring member 9 includes a pair of telescoping tubular members 14, 19 (the former being of smaller size than the latter) and the length of each member 8 and member 9 is adjustable. A jack is located at the lower terminal end of each member, a jack including a foot or platform member 11, having a nut 16 welded on the upper side thereof, which engages with externally threaded member 13. The platform member 11 is fastened to the threaded member 13 by means of pin 12. Members 15 are nuts attached permanently within tubular member 14. Member 13 provides tool-engaging means 16 for elongating and contracting the length of vertical posts 8 and shoring members 9 by rotation of the said member 13 which moves it upwardly or downwardly within the tubular member 14. The telescoping tubular members 14, 19 are also provided with means for lengthening and shortening the vertical posts 8 or shoring members 9. The pins 17 are thus removable passing through tubular members 19, 14 and shank members 18, 20. Members 14, 18 have a plurality of lateral openings within which the pins 17 can be fitted or removed thus permitting elongating and contracting vertical posts 8 and shoring members 9 in uniform increments. Member 20 is an attaching lug or shank which permits attachment of member 19 to beam form 5. Member 18 is also a lug or shank which is permanently attached to member 7.

Figure 7A:
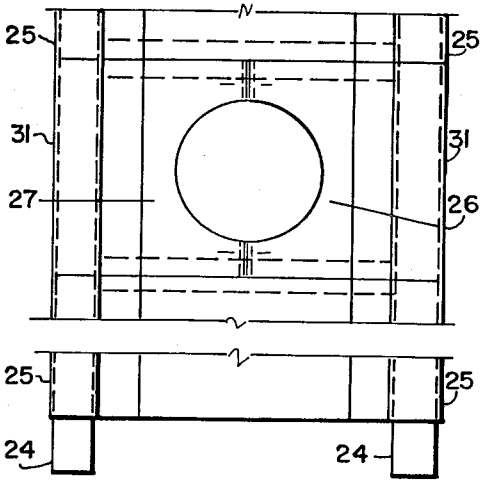
FIG. 7A is a plan view of the said removable section at columns.
Figure 7B:
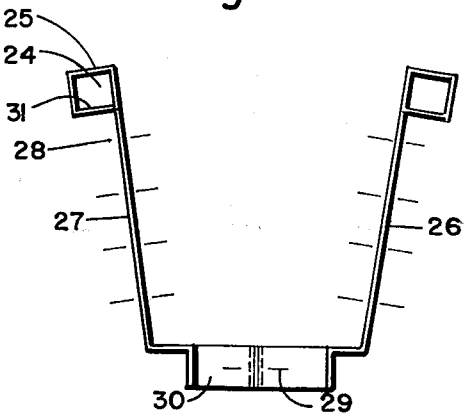
FIG. 7B is a cross-sectional view of said removable section at columns.
Figure 7:
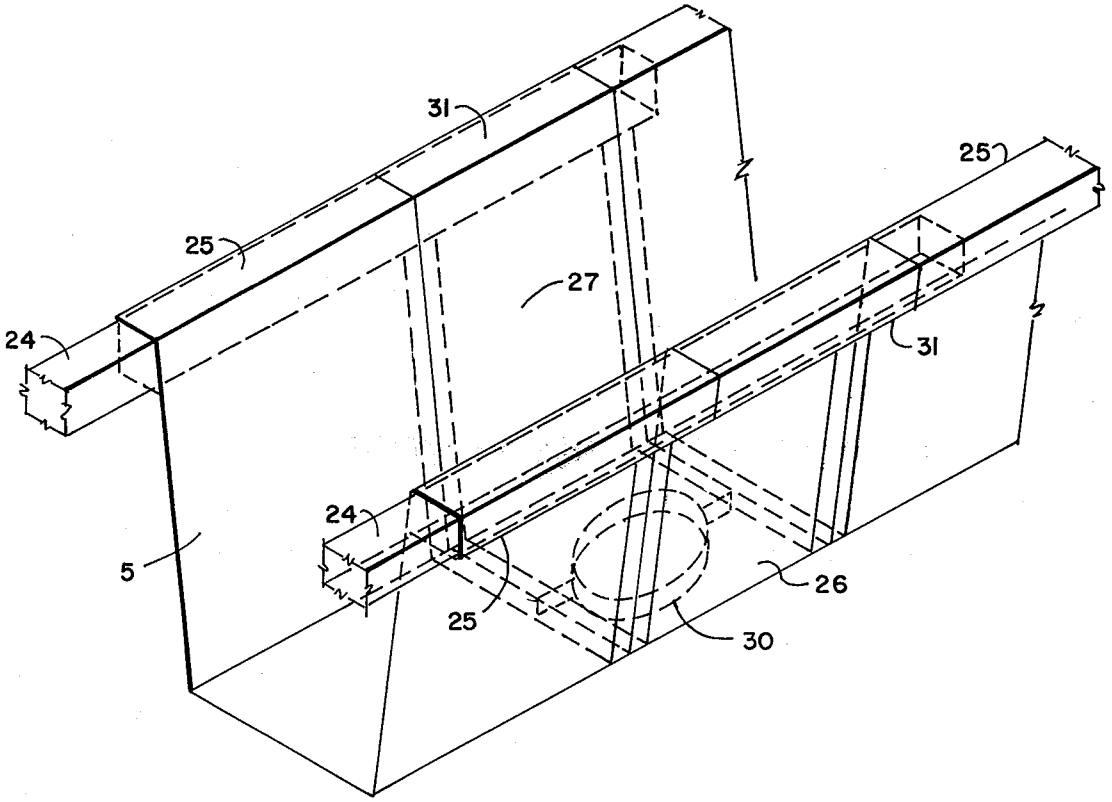
FIG. 7 is an enlarged fragmentary isometric view showing the removable section of the concrete pour form at columns used for pouring beams.

The troughs 5 are designed in such manner that both beams and columns can be cast simultaneously, the required structural elements of which operation is best shown by specific references to FIG. 7, 7A and 7B. A trough 5 is thus provided with oppositely desposed paired removable panels 26, 27 each of which is provided with bottom semi-circular shaped notched lower edges and downwardly projected surrounding walls 30 which, when fitted together with fastner 29, form a circular opening with an enclosing downwardly projecting collar. The panels 26, 27 overall are generally of U-shaped cross-section when fitted together and each of the upper edges are welded to tubular member 31 to form a contiguous tubular edge member 25 through which a slightly smaller tubular member 24 can be passed to hold or secure the panels 26, 27 in place. By such construction the upper portion of a tubular member or column pour form (not shown) can be secured within the opening formed between walls 30. The tubular member and the trough 5 itself can then be filled with wet concrete to form beams and columns. After the concrete has cured the panels 26, 27 at columns can be removed by withdrawal of bar 24 and fastner 29. The outer wall constituting the tubular column form member can then be removed from the concrete columns after which trough 5 can be lowered below the poured set of concrete beams and pushed inwardly to clear columns by telescoping tubular members 21 back within the members 7.

Figure 6:
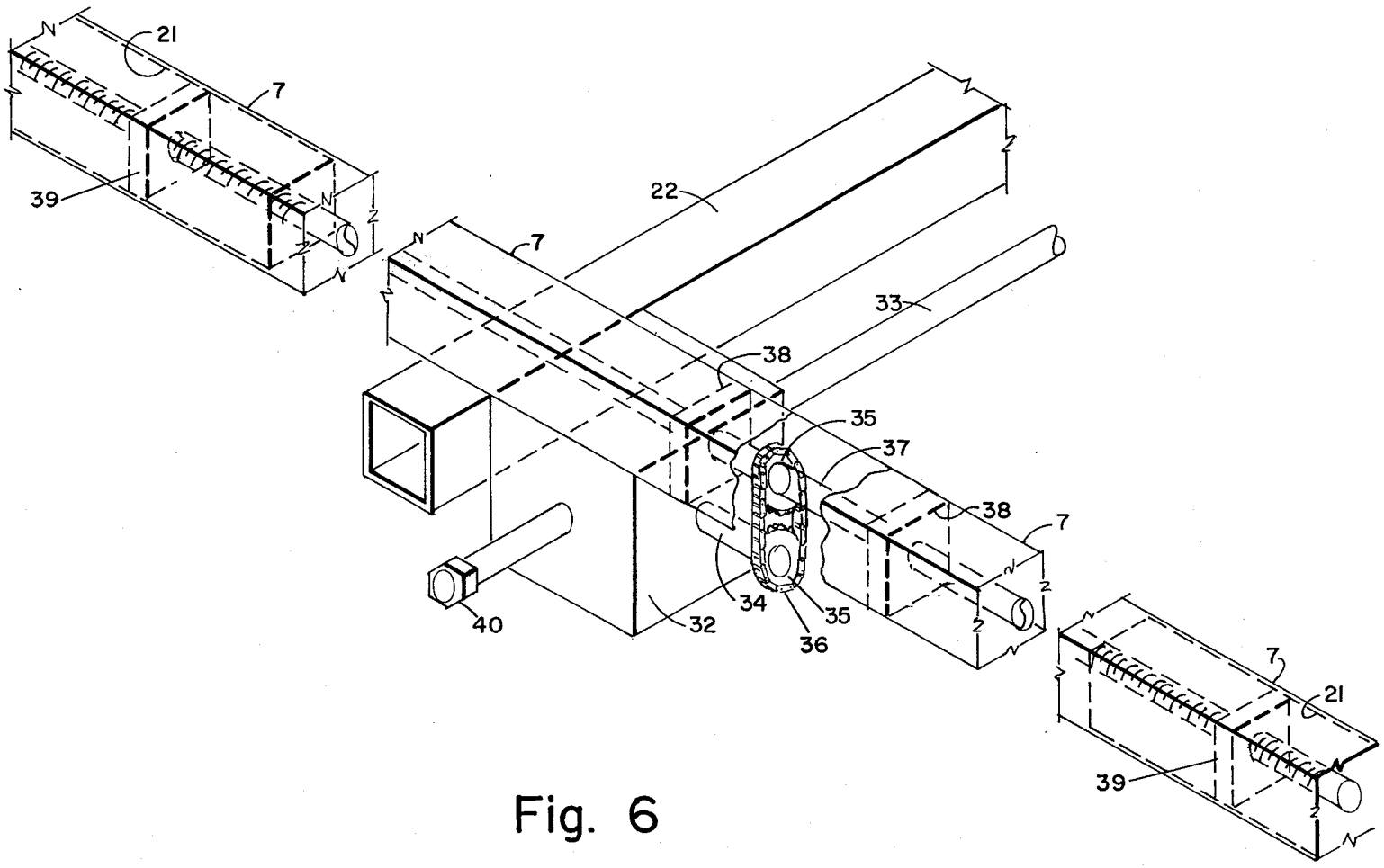
FIG. 6 is an enlarged fragmentary isometric view showing the telescoping mechanism for retracting the main beam forms which carry concrete pour forms of the type used for forming beams and columns.

In accordance with the best mode of practicing the present invention, in preference to manual manipulation, mechanical means are provided wherein both troughs 5 can be simultaneously projected or withdrawn, after panel members 26, 27 have been removed or swung away from the poured set columns. A series of miter gear boxes 32, aligned for convenience upon a fixed tubular member 22, are communicated one with another via a shaft 33 and each can be operated by rotation of the shaft 33 to extend or retract the troughs 5. One such unit is described by reference to FIG. 6. A shaft 37, having threads of opposite cast, can thus be fitted within tubular members 7, 21, aligned with the axis of the tubular members via passage through bushings 38, affixed within tubular members 7, and threadably engaged with nuts 39 affixed within tubular member 21. The shaft 37 is fitted with a sprocket 35 and coupled via a chain 36 with a parallely aligned drive shaft 34 provided with a similar sprocket 35, the latter being driven through a miter gear box 32 affixed upon the tubular member 22. Rotation of the shaft 33, e.g. by rotation of the nut 40 affixed thereon as by operative engagement therewith of a machine tool, will produce rotation of shaft 34, and, consequently rotation of shaft 37. Rotation of shaft 37 in one direction, on the one hand, will cause tubular members 21 to telescope inwardly and, conversely, rotation in the opposite direction will cause the tubular members 21 to telescope outwardly.

Figure 2:
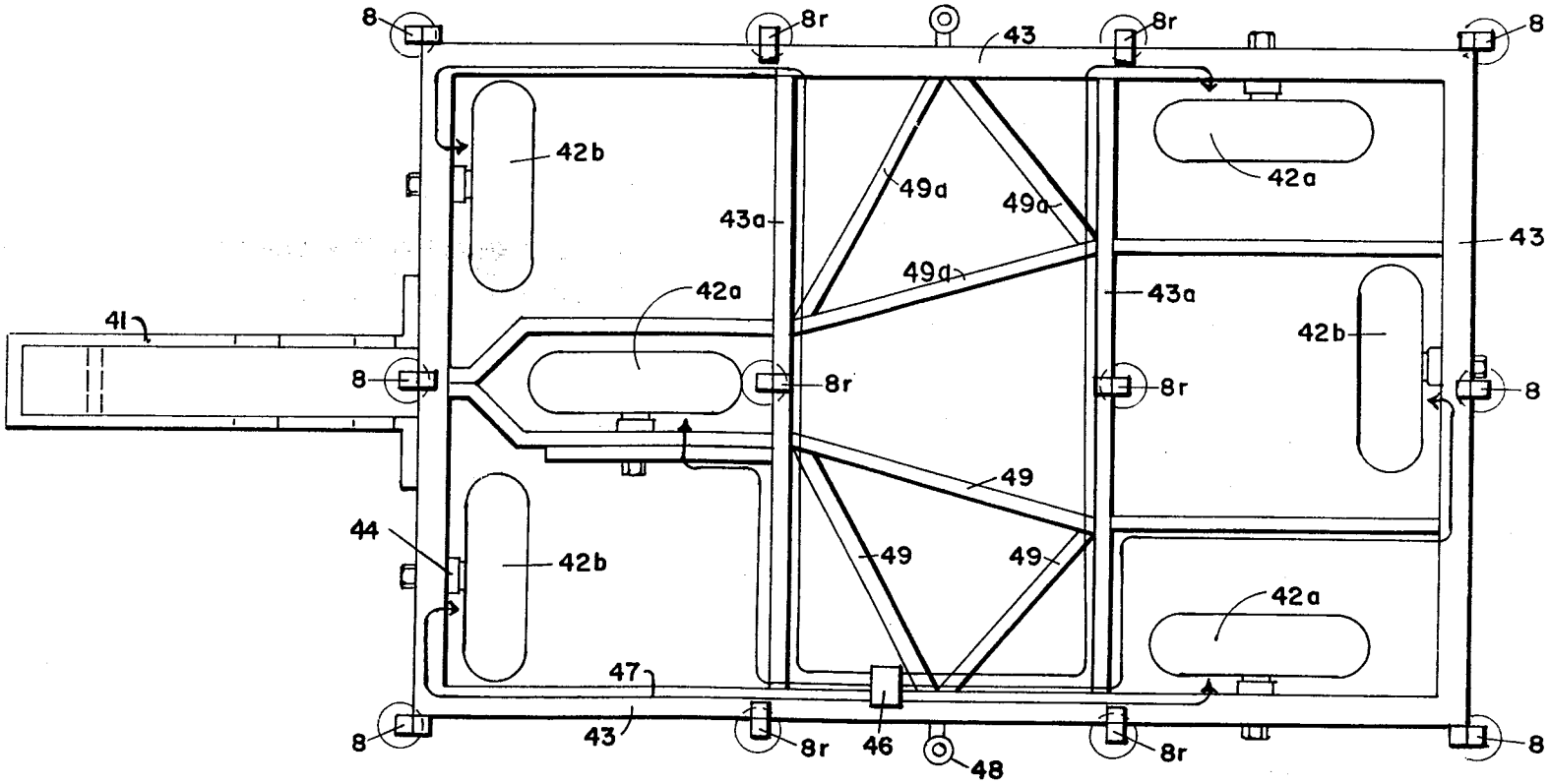
FIG. 2 is a plan view showing the carriage, or carriage assembly, which can be used for transport and positioning of a workpiece, particularly the concrete form, or concrete form assembly.

The carriage 10, best described by specific reference to FIG. 2, is preferably used in combination with the concrete form support 100 detachably mounted thereon, but is also susceptable for use in other services for transporting or positioning other different types of equipment or workpieces which need not be described herein. The frame of the carriage is constructed of a channel frame 43 resembling a parallelogram. The structure of channel members 43 is reinforced by the inner channels **43*a* which are perpendicular to, intersect and connect with the side channels 43. Additional structural support is added by channel members 49 and 49*a*. Two independent sets of wheels are mounted on the carriage 10. A set, generally, of three wheels 42*a*, and a second set, generally, of three wheels 42*b*, are rotatably mounted upon eccentric axles 44 which are secured to frame 43. By utilizing two sets of three wheels independently mounted at right angles with one another, the carriage 10 has infinite mobility for the positioning and alignment of workpieces, particularly the concrete form support 100.**

Figure 8:
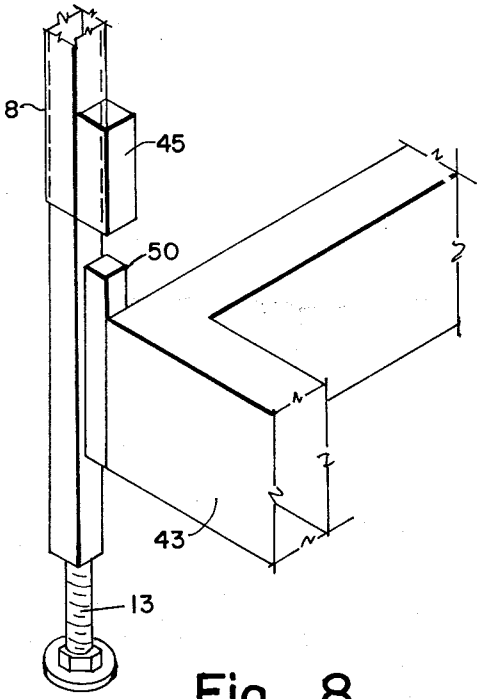
FIG. 8 is an enlarged fragmentary isometric view showing the carriage break away unit which allows the carriage to be removed from the concrete form support section.

The carriage 10 is engaged to the form support structure at points marked 8 and **8*r* as shown by reference to FIG. 2. The means of engagement or disengagement from the form support structure is best illustrated by reference to this figure and to FIG. 8,** the structural elements of which are as follows:

Member 45 is a tubular segment which is permanently attached at a corner of frame 43 of the carriage. With the members 45 and 50 engaged and the carriage wheels 42 inflated, a foot 11 of each of the vertical support members 8 and **8*r* rests on the floor or foundation. Vertical support members 8*r* are retracted with foot members 11 removed. Member 13 is retracted within member 14 and with pin 17 removed member 14 is retracted within member 19 (See FIG. 13). The remaining vertical support members 8 remain to support the weight of the form support structure. The carriage 10 is separated from the concrete form 100 by deflating tires 42. On deflating tires 42, lug 50 will lower and become disengaged with socket 45 and the carriage can be removed from beneath the form support structure. Members 8*r* are then extended and adjusted to provide further support for the concrete form on subsequent pouring of the concrete. Towing eye 48 is utilized in manuvering the carriage laterally while tires 42 are supporting. Control console 46, mounted on frame 43 is a means of rapidly varying air pressure to tires 42*a* and 42*b* through air tubing members 47. Member 41 is a detachable towing arm utilized in transporting the carriage, or both the carriage support structure and concrete form, via highway from one jobsite to another with the carriage supported on the pair of rear wheels 42*a*** (dual tires optional), while the other wheels are retracted.

A key and novel feature of the present invention relates to the method of raising and lowering the carriage 10, and supported concrete form 100, by rapid inflation and deflation of the pneumatic tires in combination with the adjustable eccentrics on which the wheels are mounted upon the carriage. The means by which one set of wheels **42*a* supports the carriage while the other set of wheels 42*b* is non-supporting, and vice versa, is best shown by specific reference to FIGS. 9 and 9A. Each wheel is thus affixed to the carriage frame or channel 43 by use of an eccentric wheel mounting device such as described by reference to these figures. An eccentric member 44 is mounted upon the carriage frame 43 and a spindle 51, which carries a wheel, is permanently attached to eccentric member 44. Eccentric member 44, permanently attached to the bolt 52 which is pivotally mounted upon the channel 43 via passage of bolt 52 through the bearing element or sleeve 56 mounted within an opening through the channel, and the bolt 52 is held in place by the washer 53A and the nut 53. A collar 54, permanently affixed upon channel 43 on the side of channel 43 opposite the eccentric member 44, is slotted at desired increments to permit adjustment of the wheels at different levels of elevation. In this instance 90° increments are provided, thus permitting the spindle 51 to be elevated or lowered by latching the said spindle 51 in one or the other of four position levels by passage of the pin 55 through the openings formed between the slots of collar 54 and the washer 53A, and through an opening through the bolt 52**.

Figures 9, 9A, 14:
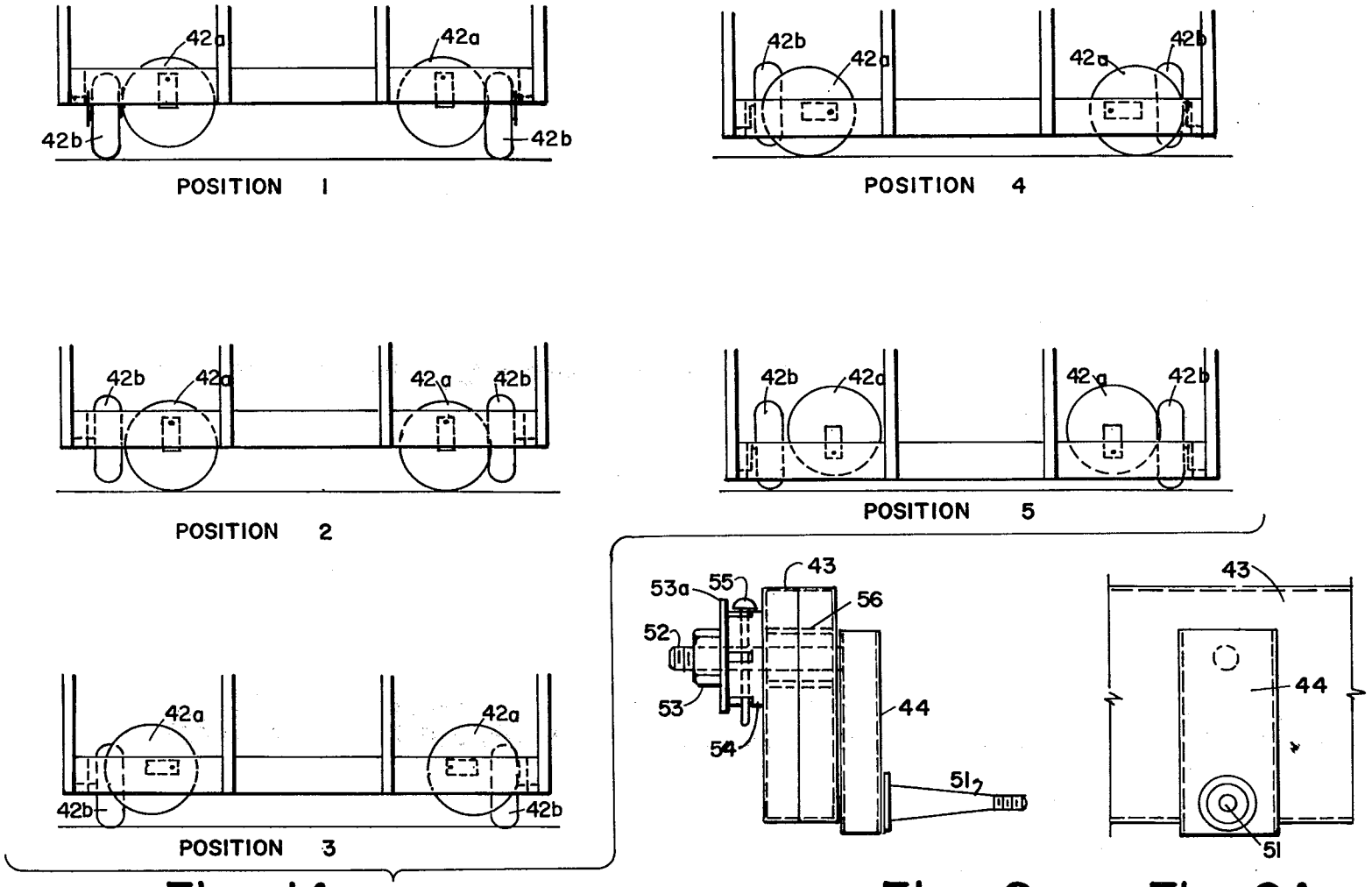
FIG. 9 is an enlarged side view showing details of the eccentric axle by virtue of which the various wheels are attached to the frame member.
FIG. 9A is a front view of the same eccentric axle.
FIG. 14 is a diagramatic representation of a series of views showing a step by step sequence of lowering the carriage and form assembly for removal after concrete has cured sufficiently.

The manner in which a set of wheels is lowered or raised relative to another to lower or elevate the carriage 10 is illustrated by reference to FIG. 14. Five different positions which illustrate the lowering (or raising) of the carriage 10 is described as follows:

Position 1: This figure illustrates the carriage resting on wheels 42*b* as would be the position of the carriage at maximum height. The sets of eccentrics of wheels 42*b* and 42*a* are inflated and are in the down position.

Position 2: The tires of wheels 42*b* are deflated until the carriage weight is supported on wheels 42*a*. As soon as wheels 42*a* are supporting the weight the eccentrics of wheels 42*b* are loosened and 42*b* is reinflated and 42*a* partially deflated causing 42*b* to rotate 90° to the horizontal position, and the eccentrics on 42*b* are then locked in this position.

Position 3: The tires of wheels 42*a* are further deflated until the carriage weight is again supported on wheels 42*b*. The eccentrics of wheels 42*a* are loosened and 42*a* is reinflated and 42*b* partially deflated causing 42*a* to rotate 90° to the horizontal position and the eccentrics on 42*a* are locked at this position.

Position 4: The tires of wheels 42*b* are again further deflated until the carriage weight is supported by wheels 42*a*. The eccentrics for wheels 42*b* are loosened and 42*b* is reinflated and 42*a* partially deflated causing 42*b* to rotate 90° to the up position and the eccentrics on 42*b* are locked at this position.

Position 5: The tires of wheels 42*a* are again further deflated until the weight of the carriage is supported on wheels 42*b*. The eccentrics for wheels 42*a* are then loosened and 42*a* is reinflated and 42*b* deflated causing 42*a* to rotate 90° to the up position and the eccentrics on 42*a* are locked at this position. Further lowering can be done by deflating the tires of wheels 42*b*.

To elevate the carriage the above procedure is merely reversed. In order to accomplish the above procedures rapidly an air console 46 design will incorporate two levers with deflate, inflate, and off positions, so each set of 3 tires can be inflated or deflated simultaneously.

In an operation, the concrete form support 100, mounted on the carriage 10, is brought to a job site for use usually after the columns, footings, or foundations and floor slab 1 has been completed. An initial concrete module comprising a roof, ceiling or floor supported upon columns and beams is begun after the concrete form support 100 has been set in place, detached from the carriage, supported and positioned for pouring as described. The carriage 10 is disengaged from the concrete form 100 and can be used to transport and position other concrete forms for pouring.

When the concrete has sufficiently cured to be self-supporting the carriage 10 can be re-engaged with the concrete form support structure 100 by reversing the removal procedure described above, as suggested. The concrete form support structure is then lowered so the beam forms or troughs 5 will pass below the poured concrete beam as described and illustrated by reference to FIG. 14. The removable sections of the troughs 5 at columns (FIG. 7) are removed allowing the said troughs 5 to be retracted as described in conjunction with FIG. 6. The carriage is then moved to the next position and aligned with the previous construction by over-lapping the concrete pour forms over concrete previously poured. The beam forms or troughs 5 are then extended outwardly and the form supports are then raised to the proper height, the removable trough or beam form sections of columns are reinstalled and the carriage can be disengaged for use with other form sections.

Figure 10:
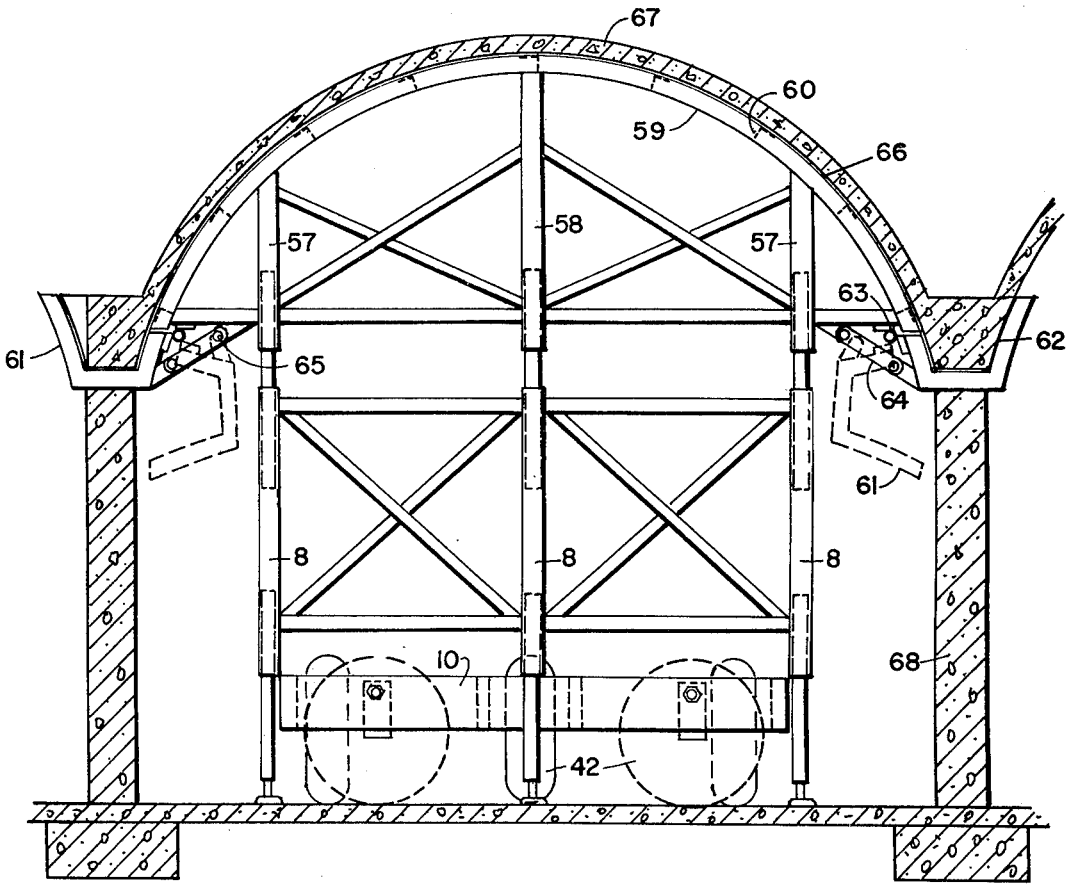
FIG. 10 is an end elevation view of the carriage and form support frame with a preferred type of arch form.
Figure 11:
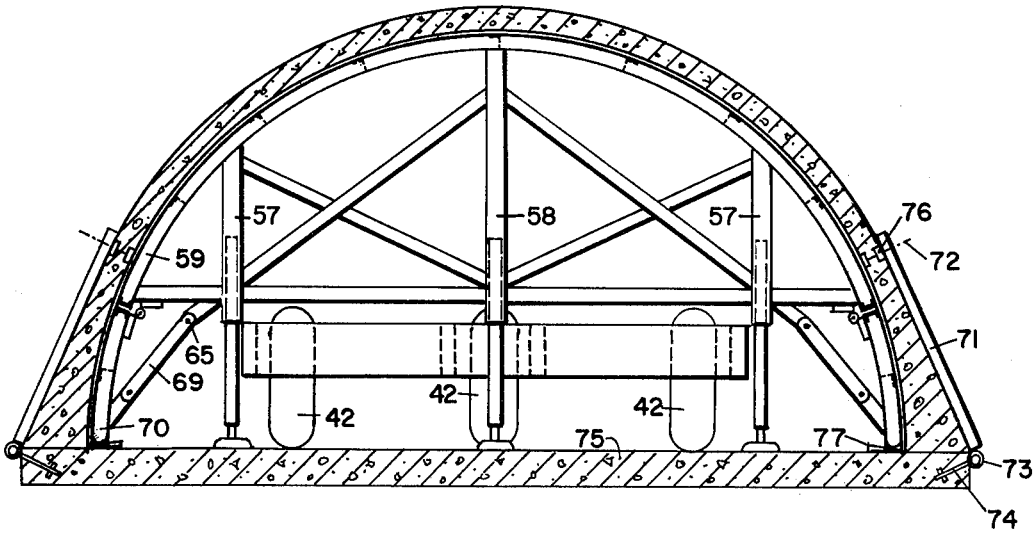
FIG. 11 is an end elevation view showing the carriage supporting the arch form with beam forms replaced with curved section as used to pour tunnels, drainage structures, or quonset type building structures.

Modified designs of the concrete form support, in association with the carriage previously described or a somewhat modified version thereof, are shown by reference to FIGS. 10 and 11. The principle difference between these designs and those previously described relates to the use of a highly contoured or semi-circular arch upon which a roof or ceiling is to be poured, and the difference in structure by virtue of which the beam forms or troughs are disengaged or freed from the poured concrete beams and columns.

Referring specifically to FIG. 10, it will be seen that the carriage 10 and shoring elements 8, 9 are as previously described, but herein are utilized with posts 57, 58 to support the members 59 which are rolled in a semi-circular arch. The members 60 are permanently attached to members 59 and run in perpendicular planes thereto. The troughs or beam forms 61 readily fit upon previously shaped concrete beams 62, and hence continuous pouring of modular shapes by moving the concrete form is quite feasible. The trough or beam form 61 is hinged to the arch shaped member 59 via hinge 63 and can be readily swung free of the poured concrete beams and posts after the concrete 67 has set, as shown in phantom. The hinge 63 in the final position is braced with member 64 secured with pins 65. Member 61 is lowered by removing pins 65 and member 64. Member 61 is interrupted at equal intervals to provide a removable section at column lines similar to that previously described and illustrated by reference to FIG. 7. Members 59 and 60 form a support for form 66 which may be sheet steel, plywood, formboard, etc. after hardening of the poured concrete 67, members 61 are lowered and carriage 10 is lowered by deflating tires 42, allowing the unit to be repositioned for next disposed section of structure. This configuration of the invention is suitable for producing concrete buildings with a plurality of arches running parallel to each other, these being supported by concrete columns 68 or steel columns, as desired.

A carriage and concrete form support particularly useful for the construction of a concrete tunnel or drainage structure is described by reference to FIG. 11. The carriage in this instance is provided with only a single set of wheels 42 and, since high elevation of the arch member 59 is unnecessary shoring posts 8 are not needed, and there are no troughs or beam forms. Referring specifically to the figure it will be observed that the basic difference between the structures relates only to the hinged lower section of the arch form by virtue of which the arch can be freed from the poured concrete and moved from one location to another, or positioned for the pour. It will be observed than the pivotable section 70 is adjoined to member 59 via a hinge, and it is braced with member 69 and secured in place with pins 65. Eye bolt 73 is embeded in slab 75 to attach form 71 at its lower end. Bolt 72 with nuts 76 support the upper end of form 71. After hardening of the concrete, the assembly is lowered by permitting the member 70 to swing inwardly and lowering carriage 10 by deflating tires 42 for movement of the assembly to next disposed section. Forms 71 are removed and eyebolt 74 and bolt 72 remain in the concrete structure. Carriage 10 utilizes the break-away feature shown in FIG. 8.

Figure 15:
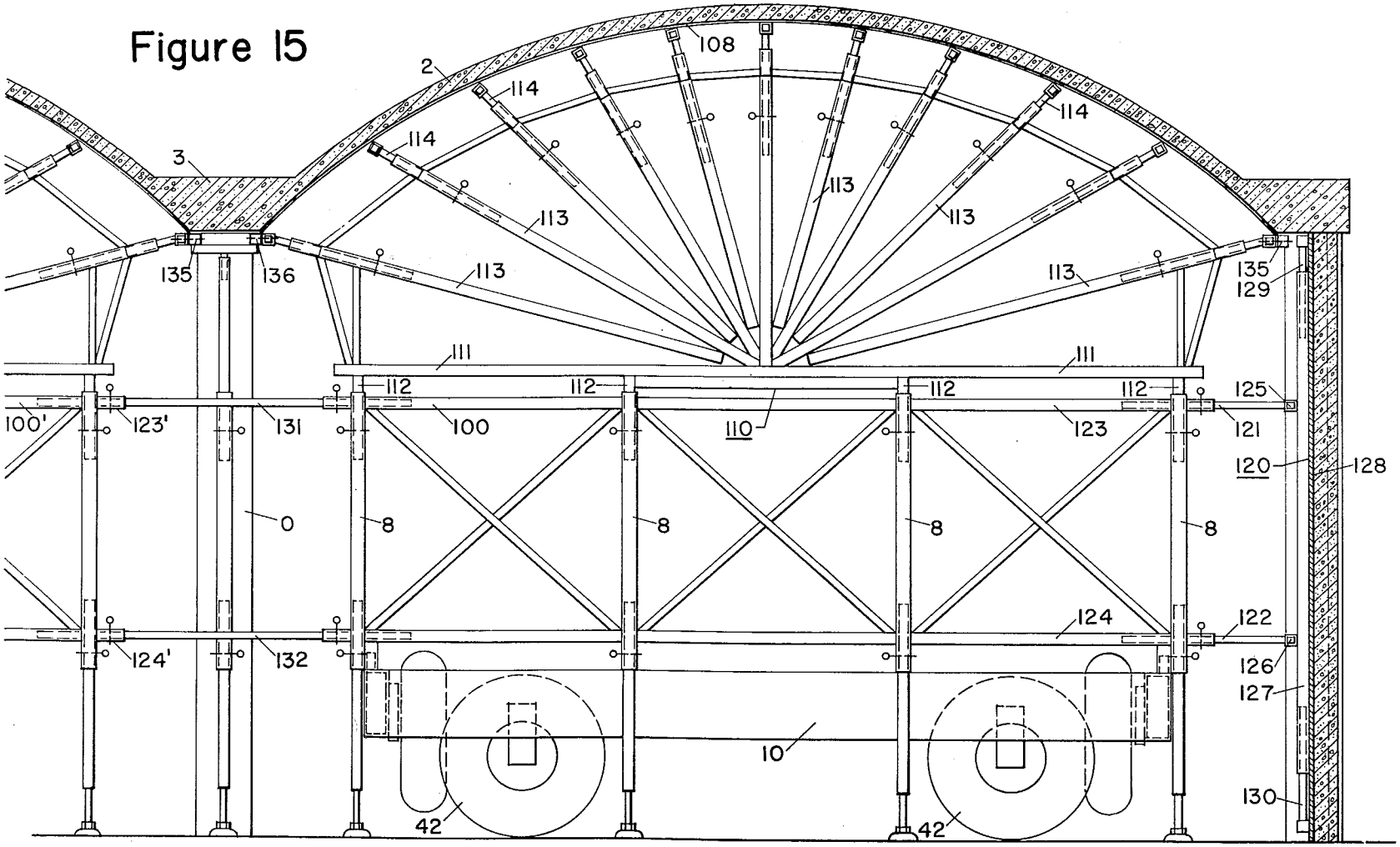
FIG. 15 is a side elevation view of the carriage described in FIG. 1, used for transport of a particularly preferred type of concrete form, or concrete form assembly, provided with an overhead pour form for use in pouring a concrete roof structure, and vertically oriented pour form for use in pouring a concrete wall.
Figure 16:
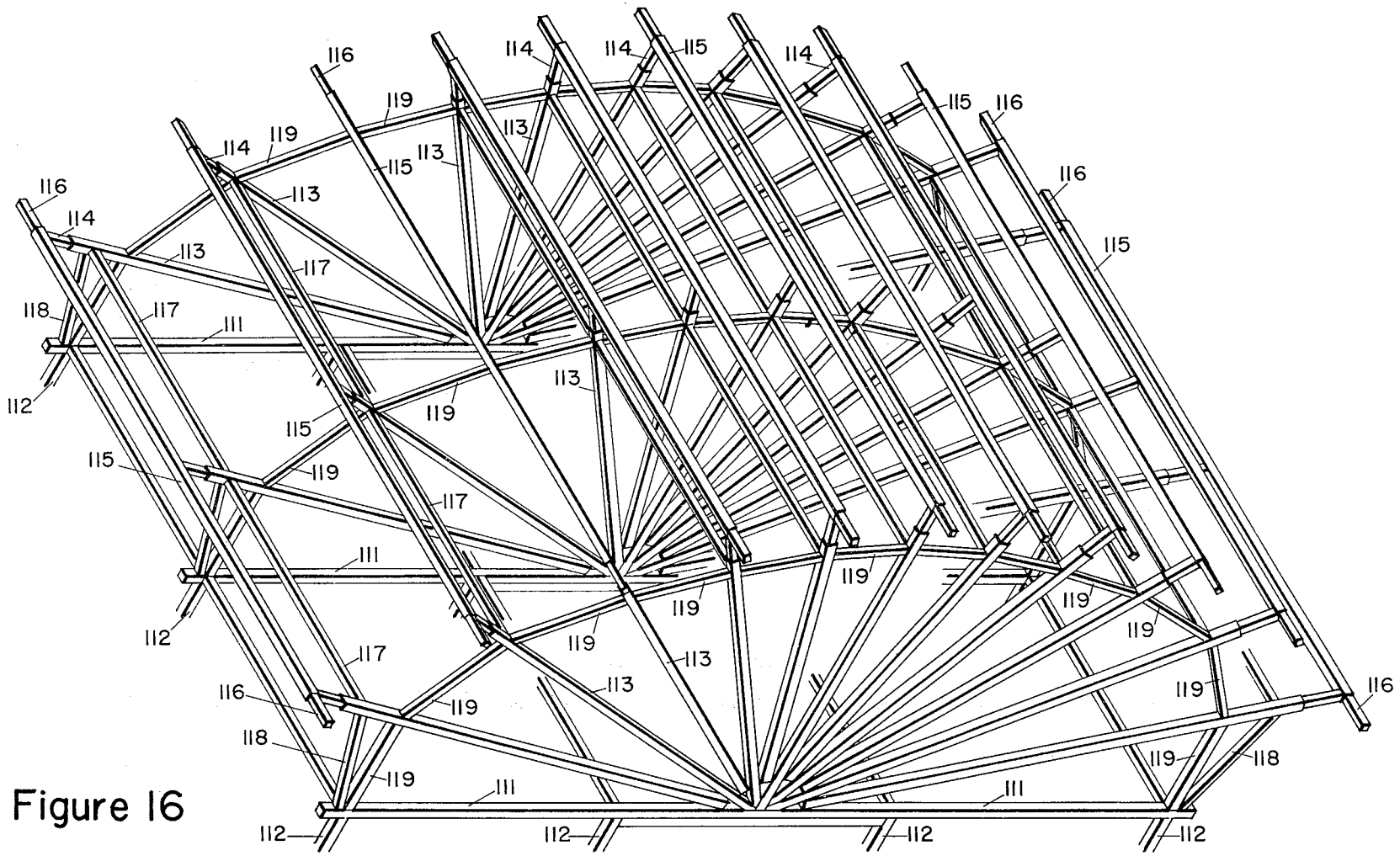
FIG. 16 is an isometric view of the overhead framework for supporting concrete pour form (shown in FIG. 15) which can be used to pour vaulted concrete roof structures which range in length of span and in contour from circular to elliptical.

Referring to FIG. 15, there is shown in combination a carriage 10 and concrete form support 100, as described by reference to FIGS. 1 and 2. A particularly preferred type of overhead pour form support 110, shown in greater detail in FIG. 16, however, replaces the pour form support shown in FIGS. 1, 10 and 11. Pour form support 110, as shown by reference to FIGS. 15 and 16, is constituted of a plurality of horizontally oriented beams 111, each rigidly affixed and supported upon a plurality of vertically oriented posts 112 which fit inside of, and telescope within, tubular posts 8 of concrete form support 100. The pour form support 110 also includes a plurality of posts 113 which are projected radially outward, generally from a common support member centrally located on a horizontal beam 111. The pour form support 110 includes a plurality, i.e. at least two, and preferably three, of the horizontal beams 111, serially aligned, parallel one to another and on each of which is provided a series or bank of radially aligned posts 113, (provided with lateral opening, not shown) e.g., a bank containing eleven in number of the posts 113, each separated one from the other by a 15° angle. The individual posts 113 of a given bank, or series, are aligned in a common plane, and the planes formed by the posts 113 of each bank, or series are arranged in parallel. Horizontally oriented tubular beams 115, provided with vertical posts 114, containing perforations, or lateral openings (not shown), adjoin the radial posts 113. The vertical posts 114 fit inside and telescope within the radial posts 113 so that the parallel aligned horizontal tubular beams 115 form an adjustable base for supporting concrete form board 108 (wood, fiberglass, or plastic) to provide surface for pouring wet concrete thereon. The width of the base formed by horizontal beams 115 can be readily attached to similar framework shown in FIG. 16 by extending and fitting the smaller diameter tubular beams 116 within the horizontal beams 115 and fastening beams 115 and 116 together by use of bolts. By this method a series of concrete form supporting structures (FIG. 16) can be attached together and aligned to form a relatively long vaulted concrete form for pouring wet concrete thereon. The horizontal beams 117 and the bracing members 118, 119 are added for structural support.

A key and novel feature of the overhead pour form support 110 is that the individual beams 115 can be moved independently inwardly or outwardly to form a wide range of sizes and varying shaped vaulted roofs. Suitably, the heights of the individual beams 115 are adjusted for a pour, at a preselected contour, and the individual beams 115 held in place via the use of bolts or pins (not shown) which are passed through spaced openings (not shown), located at optional desired distances apart, contained within posts 113, 114 through which the pins are passed, in the manner in which the members are adjustably joined together at desired positions, as described by reference to FIGS. 12 and 13. In referring to FIG. 15 it will thus be observed that a series of the structural combinations defined by concrete form support 100 and pour form support 110 are secured together to form adjoining modular concrete units separated one from another by beams 3 and columns 0 and the carriage 10 is located beneath the structure defined by concrete form support 100 and pour form structure 110 which supports the central span of the roof 2. Thus, the framework of concrete form support 100 is linked to similar adjacent structures via tubular sections 131, 132 which telescope or fit inside the horizontally oriented tubular members $123^1$, $124^1$, of adjacent concrete form support $100^1$. It will also be observed that tubular beam members 135, 136 are attached to and supported by vertical support member (FIG. 13) making up the complete beam support structure. The lowermost oppositely disposed beams 115 and beams 135, 136 are provided with a series of holes for bolts to rigidly secure these members in place while concrete is poured.

By virtue of this novel structural combination once the concrete has set it is but a simple matter to unfasten tubular beams 115 from beams 135, 136, slide tubular sections 131, 132 into the horizontally oriented tubular members $123^1$, $124^1$ of concrete form support $100^1$ and then remove or slide the vertically oriented pour form out of the way so that the vaulted portion of the concrete pour form support 110 can be lowered simply by deflating the tires 42 of carriage 10. The form is thus separated from the thin shell vaulted concrete structure and moved to new pour position. The vertical support structure under beam 3 remains in place for a longer period as required for proper curing.

The concrete form support 100, as shown by reference to FIG. 15, is also provided with a vertically oriented pour form 120 which can be used in pouring concrete walls. Referring to FIG. 15, there is thus shown a plurality of horizontally aligned posts 121 at an upper level, and a plurality of horizontally aligned posts 122, at a lower level of elevation. The posts 121, 122 are of relatively small cross-section, each set of posts 121, and each set of posts 122 fitting and telescoping within a set, or plurality, of horizontally oriented tubular members 123 and 124, of larger cross-section respectively, which form a portion of the framework of concrete form 100. Cross bars 125, 126 are fitted perpendicularly across the terminal ends of posts 121, 122, respectively, these members being affixed to and supporting a plurality of vertically oriented tubular members 127 upon which a concrete pour form 128 can be secured. Suitably, the concrete pour form 128 is held in place upon the members 127 via short, small diameter bar segments 129, 130 which are secured to the concrete pour form 128 and telescope within the vertically aligned tubular members 127. The surface of the concrete pour form 128 may be flat or provided with crests and troughs to provide a suitable structural wall using less concrete. Concrete to be applied on concrete pour form 128 using suitable concrete pump.

It is thus understood that the invention is a highly useful means and method for constructing reinforced concrete buildings, tunnels, underground shelters or drainage structures utilizing a relatively small number of forms in succession to construct individual sections of the structure, the forms being removable as the concrete supported thereby becomes sufficiently hard to support itself. Practically all of the available forms may be used simultaneously and continuously, with a minimum of idle time, whereby both material and labor savings are effected.

I claim:

1. A concrete pour form support for use in pouring of vaulted type roofs which is mounted on a transportable type carriage for moving as a unit from one job site to another, which concrete form support can be detached from the carriage, removed for further service and later reunited with the carriage for removal to a new pour position, the combination comprising a horizontal frame assembly wherein is included a plurality of parallelly aligned, horizontally oriented beams, which lie in a common plane, a plurality of vertically oriented posts affixed upon each of the said beams, each post being extended downwardly for attachment to the carriage, a plurality of parallel sets of aligned tubular posts, the number of tubular posts in a set being substantially equal, the posts of each set radiating outwardly from substantially the center of the parallelly aligned, horizontally oriented beams constituting the horizontal frame assembly, a plurality of cross-bars corresponding in number with the number of tubular posts in a set which radiate outwardly from a beam located in the horizontal frame assembly, each cross-bar containing a plurality of downwardly projected, perpendicularly attached members which provide a telescoping fit with the tubular posts of the parallel sets of aligned tubular posts so that the said cross-bars can be adjusted inwardly or outwardly with regard to the aligned tubular posts to provide a surface which can be covered and rendered suitable for pouring thereon vaulted type concrete roof structures ranging in length of span and in contour from circular to elliptical.

2. The apparatus of claim 1 wherein the aligned tubular posts affixed upon the horizontal frame assembly, and the downwardly projected, perpendicular members of the cross-bars are telescoping members, and locking means are provided whereby the individual cross-bars can be raised, lowered and locked to vary the contour of the concrete pour form.

3. The apparatus of claim 2 wherein the aligned tubular posts and the downwardly projected, perpendicular members of the cross-bars are each provided with a plurality of lateral openings through which pins can be passed to lock the concrete pour form support at the desired location.

4. The apparatus of claim 1 wherein the cross-bars which are mounted upon said parallel sets of aligned tubular posts are tubular, and contain a telescoping tubular member mounted thereon which can be adjusted inwardly or outwardly thereon to vary the width of the concrete pour form.

5. The apparatus of claim 1 wherein the horizontal frame assembly of the concrete pour form support includes three of the horizontally oriented beams, secured one to another by suitable braces, at the center of each beam is provided a bank of eleven aligned tubular posts located in a common plane and separated from one another by a 15° angle, and there is provided eleven cross-bars one for extension across three parallelly aligned members of the parallel sets of aligned tubular posts.

6. The apparatus of claim 5 wherein each of the cross-bars is tubular, and tubular beams are carried by each of the cross-bars and telescoped therewith such that said tubular beams can be adjusted inwardly or outwardly thereon to vary the width of the concrete pour form support.

7. The apparatus of claim 5 wherein the three horizontally oriented beams which form the horizontal frame assembly each carry a plurality of vertically oriented posts of tubular design, each extended vertically downwardly for attachment to tubular posts located on the carriage.

8. The apparatus of claim 5 wherein each of the aligned tubular posts are joined together at the specified angle by suitable braces.

* * * * *